US006138343A

United States Patent [19]

Hill et al.

[11] Patent Number: 6,138,343

[45] Date of Patent: Oct. 31, 2000

[54] METHOD FOR MANUFACTURING A VARIABLE INSULATED HELICALLY WOUND ELECTRICAL COIL

[75] Inventors: Norris L. Hill, New Bloomfield; Thomas L. Linsenbardt, Lohman, both of Mo.

[73] Assignee: ABB Power T&D Company Inc., Raleigh, N.C.

[21] Appl. No.: 09/364,029

[22] Filed: Jul. 30, 1999

Related U.S. Application Data

[62] Division of application No. 08/905,424, Aug. 4, 1997, abandoned.

[51] Int. Cl.[7] ..... H01F 41/02

[52] U.S. Cl. ..... 29/605; 336/205; 29/650

[58] Field of Search ..... 29/605, 650, 564.1, 29/564.6, 564.8; 336/205, 206

[56] References Cited

U.S. PATENT DOCUMENTS

| | | | |
|---|---|---|---|
| 2,949,593 | 8/1960 | Staley et al. | 336/186 |
| 3,153,212 | 10/1964 | Davis | 336/149 |
| 3,504,104 | 3/1970 | Suzuki | 174/120 |
| 3,860,744 | 1/1975 | Schuler | 174/117 |
| 3,891,955 | 6/1975 | Horton, III | 336/205 |
| 4,204,087 | 5/1980 | Lin et al. | 174/120 |
| 4,406,056 | 9/1983 | Buckley et al. | 29/605 |
| 4,412,094 | 10/1983 | Dougherty et al. | 174/110 |
| 4,503,605 | 3/1985 | Buckley | 29/605 |
| 4,554,730 | 11/1985 | Westervelt et al. | 29/605 |
| 4,818,909 | 4/1989 | Balke | 310/208 |
| 5,428,337 | 6/1995 | Vinclarelli et al. | 336/223 |
| 5,504,469 | 4/1996 | McGrane | 336/206 |

*Primary Examiner*—Carl E. Hall

*Attorney, Agent, or Firm*—Woodcock Washburn Kurtz Mackiewicz & Norris LLP

[57] ABSTRACT

A method and apparatus for manufacturing a variable insulated helically wound electrical coil is disclosed. Insulated rectangular wire is fed from a supply reel to a coating zone and within the coating zone liquid resin insulation is selectively applied to the wire so it has additional insulation only in those areas of the coil where the dielectric strength is needed. The insulated wire is fed through a curing station to allow curing of the additional insulation prior to winding the cured insulated wire into a coil. The cured insulated wire is wound into a coil of predetermined shape at a winding station whereby the portions of the wire having the additional insulatin are located in the areas of the coil where the greatest dielectric strength is needed. The timing of the resin application to the wire is coordinated with the winding of the coil so that the proper insulation thicknesses are achieved at the required locations in the coil. There is also disclosed a variably insulated helically wound high voltage electrical coil for a transformer wherein a variable thickness of cured synthetic resin insulation is applied to the turns in each layer of the coil so that the insulation increases in thickness from substantially zero at one end of the layer where layer-to-layer voltage stresses will be low and the required maximum thickness at the opposite end of the layer where voltage stresses will be high and this progression and insulation thickness is repeated on each adjacent layer of the coil.

7 Claims, 4 Drawing Sheets

METHOD FOR MANUFACTURING A VARIABLE INSULATED HELICALLY WOUND ELECTRICAL COIL

This Application is a divisional of application Ser. No. 08/905,424 filed Aug. 4, 1997, now abandoned.

BACKGROUND OF THE INVENTION

1. Field of the Invention

This invention relates to the manufacture of a variable insulated wound coil, and more specifically to a new and improved method and apparatus for manufacturing a variable insulated helically wound electrical coil.

2. Description of the Prior Art

In many conventional windings, such as transformer windings, a wire winding for a high voltage section typically uses wire which has an enamel or polymer insulation on it for turn-to-turn insulation and utilizes paper insulation between layers of turns of the coil to provide adequate insulation between the helically wound layers of insulated wire. The layer insulation is generally constructed from sheet material which has a uniform thickness and a width slightly greater than the width of the wire layers. It is wound into the coil as the coil is wound. After each layer of wire has been helically wound onto the coil, one or more turns of the full width layer insulation is wound onto the layer after which the next layer of wire is wound onto the coil. This process repeats through the entire coil. With conventionally wound coils the layer insulation between layers must be thick enough to withstand the highest voltage difference between the layers. Since the windings are continuous and helically wound, the voltage between the layers varies along the coil axis, or width, with the greatest voltage difference between layers occurring between the starting end of a lower layer and the finish end of the layer above it. There is almost no voltage difference between the two layers on the opposite sides of the coil. The thickness of the full width layer insulation must be such that it provides the necessary dielectric strength on the start finish/side where the voltage difference between the layers is the highest. Over the remainder of the layer, the layer insulation is thicker than required. This results in an inefficient use of coil space, and, consequently, greater material usage.

It would be desirable to allow the full width layer insulation to be replaced by insulation that is applied onto the insulated wire so that the wire is insulated only in those areas of the coil where the greatest dielectric strength is needed.

SUMMARY OF THE INVENTION

Briefly, the present invention relates to a new and improved method of manufacturing a variable insulated helically wound electrical coil. Such method comprises the steps of feeding insulated rectangular wire from a supply reel to a coating zone and within the coating zone selectively applying a liquid resin insulation to the wire so it has additional insulation only in those areas of the coil where the dielectric strength is needed. The method further provides thereafter feeding the insulated wire through at least one curing station to allow curing of the additional insulation prior to winding the cured insulated wire into a coil and thereafter winding the cured insulated wire into a coil of predetermined shape whereby the portions of the wire having the additional insulation are located in the areas of the coil where the greatest dielectric strength is needed.

In one aspect of the invention the coil comprises multiple coil layers and each coil layer comprises multiple turns of wire. The thickness of the insulation is varied in increments during the winding of each layer so that the insulation increases from substantially zero at the first turn at the start of the layer where layer to layer voltage stresses will be low to the required maximum thickness of the last turn at the end of the layer where voltage stresses will be high and repeating the process on each succeeding layer. In one aspect of the invention, the additional insulation is applied to at least the bottom of the turns in the coil layers. In another aspect of the invention the insulation is applied to the bottom and sides of the turns in the coil layers.

The present invention also relates to new and improved apparatus for manufacturing a variable insulated helically wound electrical coil. The apparatus comprises means for feeding insulated rectangular wire from a supply reel to a coating zone and means within the coating zone for selectively applying a liquid resin insulation to the wire so it has additional insulation only in those areas of the coil where the greatest dielectric strength is needed. There is further provided means for feeding the insulated wire through at least one curing station to allow curing of the additional insulation prior to winding the cured insulated wire into a coil and means for winding the cured insulated wire into a coil of predetermined shape at a winding station whereby the portions of the wire having the additional insulation are located in the areas of the coil where the greatest dielectric strength is needed. There is further provided means coordinating the timing of the resin application to the wire with the winding of the coil so that the proper insulation thicknesses are achieved at the required locations in the coil.

In accordance with another aspect of the invention there is provided an improved variable insulated helically wound high voltage electrical coil for a transformer wherein the coil comprises multiple coil layers, each coil layer comprising multiple turns of wire and the improvement comprises a variable thickness of insulation applied to the turns in each layer of the coil so that the insulation increases in thickness from substantially zero at the first turn at the start of the layer where layer-to-layer voltage stresses will be low to the required maximum thickness at the last turn at the end of the layer where voltage stresses will be high and this progression of insulation thickness being repeated on each succeeding layer of the coil.

DESCRIPTION OF THE PREFERRED EMBODIMENTS

Figure 1:
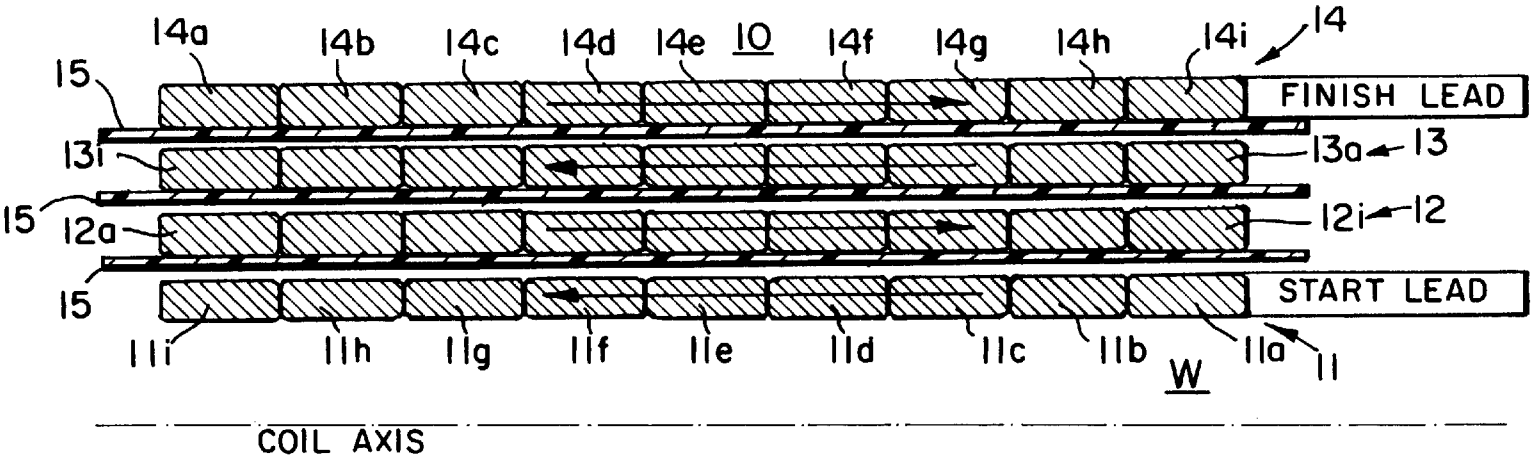
FIG. 1 PRIOR ART
FIG. 1 is a partial sectional view of a conventional helically wound wire winding of the prior art.

Referring to FIG. 1 there is illustrated a partial sectional view of a prior art helically wound high voltage coil 10 including four coil layers 11–14. The coil layers 11*a*–-11*i*, 12*a*–12*i*, 13*a*–13*i*, 14*a*–14*i* are wound in the directions of the arrows with the direction reversing for each coil layer. A wire winding of the prior art typically uses rectangular wire W which has an insulation such as enamel or polymer (not shown) on it for turn-to-turn insulation and utilizes paper insulation 15 between layers of turns in the coil to provide adequate insulation between the helically wound layers of insulated wire. The layer insulation 15 is generally constructed from sheet material which has a uniform thickness and a width slightly greater than the width of the coil layers. It is wound into the coil as the coil is wound. After each layer wire has been helically wound onto the coil, one or more turns of the full width layer insulation is wound onto the layer after which the next layer of wire is wound onto the coil. This process repeats through the entire coil. The layer insulation between layers must be thick enough to withstand the highest voltage difference between the layers. Since the windings are continuous and helically wound, the voltage between the layers varies along the coil axis, or width, with the greatest voltage difference between layers occurring between the starting end 11*a*, (12*a*), (13*a*) of a lower layer and a finish end 12*i*, (13*i*) (14*i*) of the layer above it. There is almost no voltage difference between the two layers 11*i* and 12*a* (12*i* and 13*a*) on opposite sides of the coil. The thickness of the full width layer insulation 15 must be such that it provides the necessary dielectric strength on the start finish/side where the voltage difference between layers is the highest. Over the remainder of the layer, the layer insulation is thicker than required. This results in an inefficient use of coil space, and consequently, greater material usage.

Figure 4:
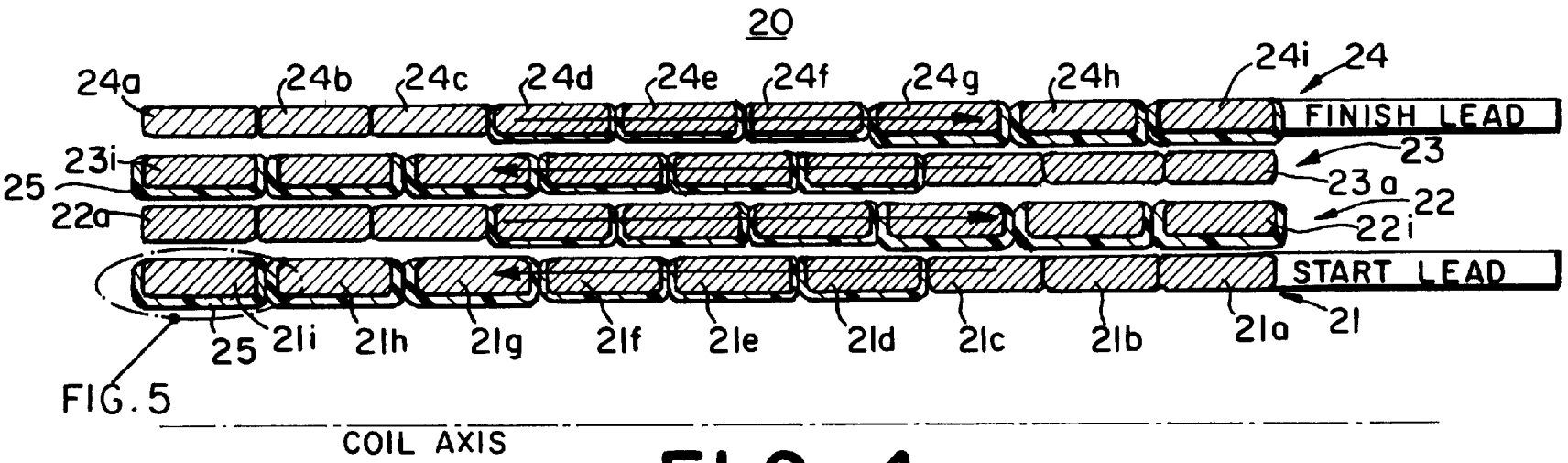
FIG. 4 is a fractional sectional view of a variable insulation helically wound wire coil embodying the present invention.

A variable insulation wound wire coil 20 constructed in accordance with the present invention is illustrated in FIG. 4. In accordance with the present invention the thickness of the insulation is varied in increments or gradually during the winding of each layer so that it increases from little or nothing at the start of the layer where layer to layer voltage stresses will be low to the required maximum thickness at the end of the layer where voltage stresses will be high. At the end of the layer, the application is abruptly stopped as soon as the last turn has been added to the layer so that the process can be repeated on the next layer. As may be seen in FIG. 4 the helically wound high voltage coil 20 includes four coil layers 21–24. The coil layers 21*a*–21*i*, 22*a*–22*i*, 23*a*–23*i*, 24*a*–24*i* are wound in the direction of the arrows with the direction reversing for each coil layer. The starting wire W used for making this coil 20 has an insulation such as enamel or polymer I on it for turn-to-turn insulation. This insulation I is not shown in FIG. 4, for reasons of clarity, but is shown in the enlarged view of the wire W in FIG. 5. This insulation I completely surrounds all external surfaces of the wire W. As pointed out above, in a helically wound coil of this type, the voltage between the layers varies along the coil axis, or width, with the greatest voltage difference between layers occurring between the starting end 21*a*, (22*a*), (23*a*) of a low layer and a finished end 22*i*, (23*i*), (24*i*) of the layer above it. There is almost no voltage difference between the two layers 21*i* and 22*a* (22*i* and 23*a*) on opposite sides of the coil 20. As may be seen in FIG. 4, a variable thickness of insulation 25 is applied to the turns in each layer 22–24 of the coil so that the insulation increases in thickness from substantially zero at the first turn at the start of the layer 21*a*, 22*a*, 23*a*, 24*a* where layer-to-layer voltage stresses will be low to the required maximum thickness of the last turn 21*i*, 22*i*, 23*i*, 24*i*, at the end of the layer where voltage stresses will be high and this progression of insulation thickness is repeated on each succeeding layer of the coil. By comparing the coil in FIG. 4 with the coil in FIG. 1 it will be seen that the full width layer insulation 15 of FIG. 1 has been replaced by the variable insulation 25 which reduces the coil build which in turn reduces the size of the entire core/coil assembly and therefore the cost of the coil.

Figure 2:
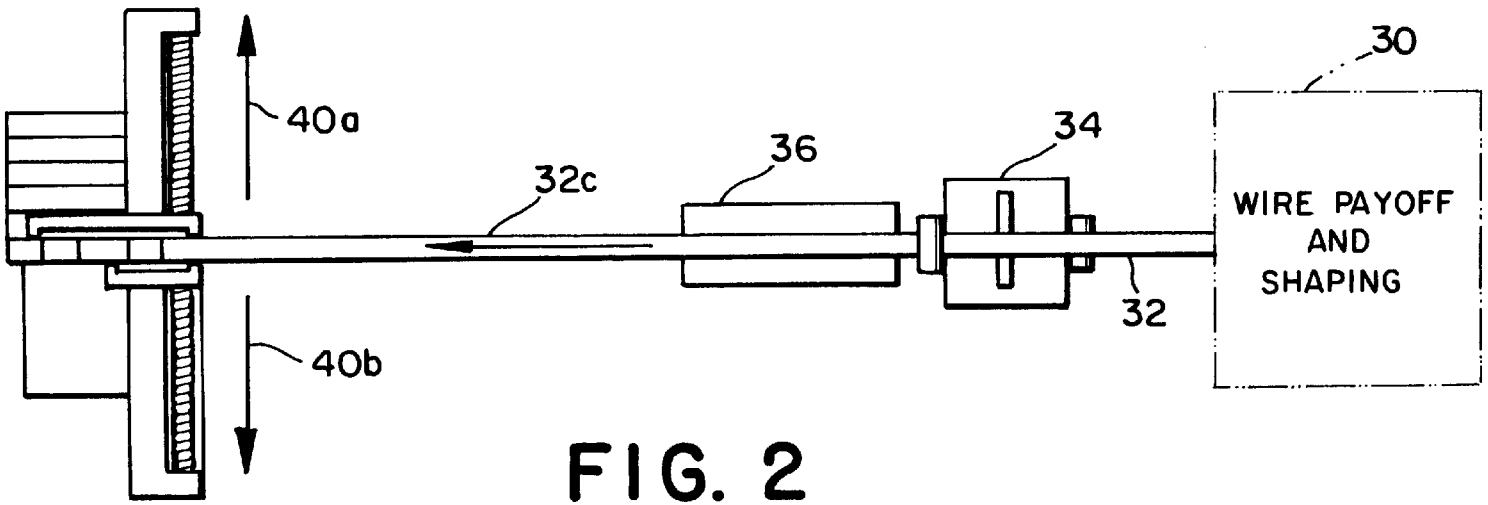
FIG. 2 is a top plan view diagrammatically illustrating a variable insulated coil winding system in accordance with the present invention.
Figure 3:
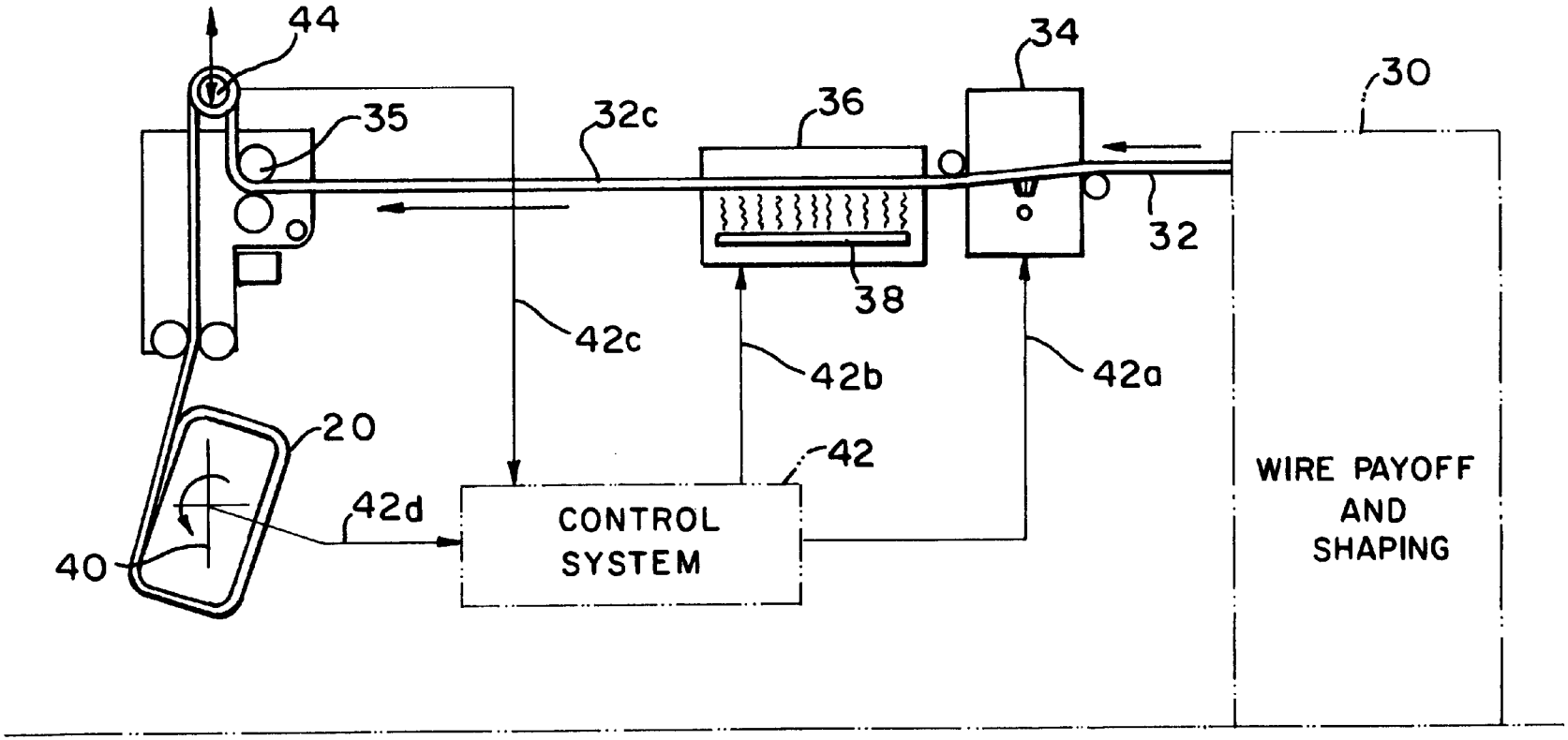
FIG. 3 is a front elevational view of the variable insulated coil winding system diagrammatically shown in FIG. 2.
Figure 5:
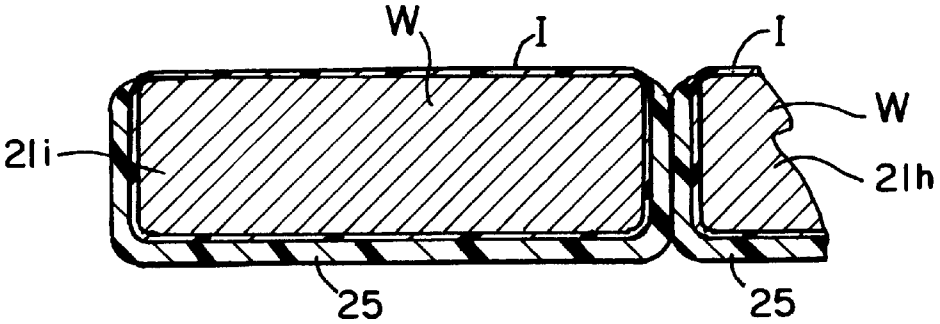
FIG. 5 is an enlarged cross sectional view of the wire conductor in FIG. 4 to which the maximum added insulation has been applied.

The method and apparatus for making the variable insulated helically wound electrical coil according to the present invention is illustrated in FIGS. 2 and 3. At the supply station 30 insulated rectangular wire 32 is paid out from reels, not shown, or round insulated wire is pulled from wheels or drums and is shaped into rectangular form. The rectangular wire 32 is then pulled through a coating device 34 at a coating zone or station where liquid resin insulation is applied to the wire so it is insulated only in those areas of the coil where the greatest dielectric strength is needed. The additional variable insulation 25 is applied to the bottom surface of the wire W at a minimum and preferably, the two sides of the wire W as shown in FIG. 5. The insulation 25 may be applied to the wire by single or multiple rollers, spray heads, dies, or vacuum chambers. It can be applied in one application and cured or in several applications, or passes, with curing between each application. The insulation thickness can be varied in the single application mode by varying the thickness at which the liquid film is applied. In the case of multiple applications, the thickness can be varied by changing the number of applications applied. This will result in an incremental change in insulation build.

After leaving the insulation coating station 34, the variably coated wire 32*c* is pulled by pulling device such as pinch rolls 35 or by the winding mandrel through at least one curing station 36 that includes ultraviolet lamps 38 or an electron beam, FIG. 3. The intensity of the lamp/beam 38 will be high enough to allow full curing of the insulation 25 prior to the insulation encountering any parts of the winding machine 40 to prevent insulation damage. In some applications, it may be desirable that the insulation be cured only to the "B" stage. This may be done in order for coil bonding to take place later, or in order to take advantage of "B" stage material properties that may be more suitable for winding. If cured only to "B" stage during winding, the insulation may be fully cured by processing after the winding operation. After the fully cured insulated wire exists the curing station 36, the wire is then wound onto the coil 20 at the winding machine spindle 40. Since the insulation is applied to the wire some distance from where the coil is being wound, a suitable control system 42, FIG. 3 is provided to coordinate timing of resin application with the winding of the coil 20 so that the proper insulation thicknesses are achieved at the required locations in the coil. The control system 42 also synchronizes the rate of resin application to winding speed in order to produce proper insulation thickness. This is provided since the speed may need to change during the reversing of the layer winding direction, and with conductor and coil size. The various controls provided by the control system 42 are diagrammatically illustrated in FIG. 3. The application rate of the insulation at the coating station 34 is indicated by connection 42*a*. The intensity of the curing lamp or electronic beam at the curing station 36 is indicated by the connection 42*b*. The control for the height of a dancer 44 and wire speed, as later to be described, is illustrated by the connection 42*c*. The control for the spindle speed and orientation is illustrated by the connection 42*d*. The reversing of the layer winding direction is illustrated by the vertical arrows 40*a*, 40*b* in FIG. 2.

The coils being wound can be circular or rectangular in shape. If the coil 20 being wound has a rectangular shape as shown in FIG. 3, a dancer roll 44 as shown in that figure is provided in the wire 32*c* passing between the coil 20 and the coating/curing operation 34/36 to keep the speed of the wire steady during coating so that the film thickness 25, FIGS. 4 and 5, will be uniform. The dancer 44 may be loaded with a constant force to maintain constant tension on the wire 32*c* while its height, as indicated by the arrows in FIG. 3, controls payoff of the wire 32 into the coater/curer 34/36. Alternatively, the motion of the dancer may be controlled and synchronized with the winding to eliminate speed variations. If the dancer is not provided, the speed of the rectangular coil winding spindle must be rotated at a non-uniform speed that is varied during each rotation to keep wire speeds steady through the coater.

While the present invention has been described in connection with applying the additional insulation to the bottom of the wire and sides as shown in FIGS. 4 and 5, it is to be understood that the additional insulation alternatively may be applied to the top of the wire and sides as well but in that case, the thickness of the additional insulation would immediately start out thickest at the start of a coil layer and be reduced as the layer is wound. This construction is illustrated in FIGS. 6 and 7.

Figure 6:
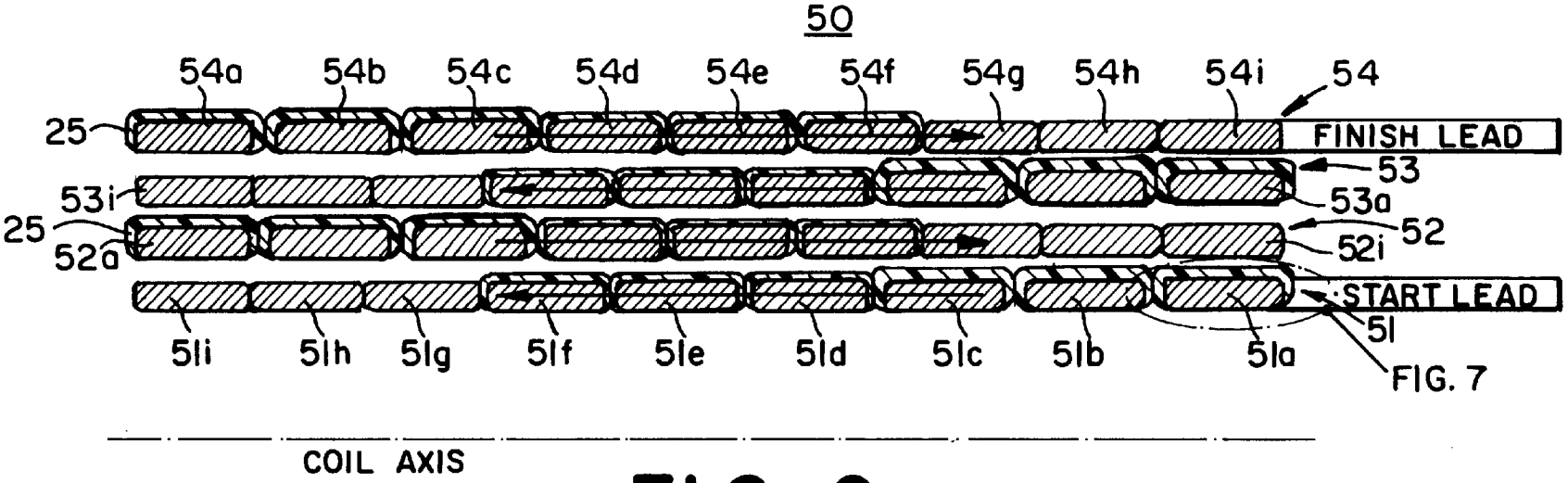
FIG. 6 is a fractional sectional view of a modification of a variable insulation helically wound wire coil embodying the present invention.
Figure 7:
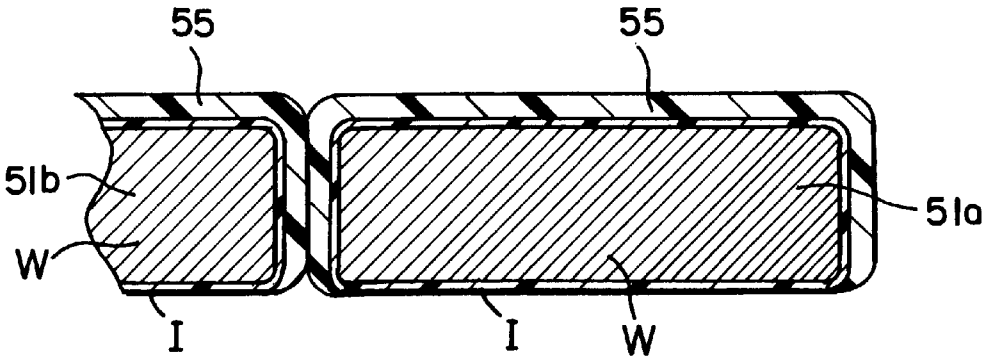
FIG. 7 is an enlarged cross sectional view of the wire conductor in FIG. 6 to which the maximum added insulation has been applied.

A variable insulation wound wire coil 50 constructed in accordance with this aspect the present invention is illustrated in FIG. 6. In accordance with this aspect of the present invention the thickness of the insulation is varied in increments or gradually during the winding of each layer so that it decreases from a maximum thickness at the start of the layer where layer to layer voltage stresses will be high to little or nothing in thickness at the end of the layer where voltage stresses will be low. At the end of the layer, the application is abruptly stopped as soon as the last turn has been added to the layer so that the process can be repeated on the next layer. As may be seen in FIG. 6 the helically wound high voltage coil 50 includes four coil layers 5154. The coil layers 51*a*–51*i*, 52*a*–52*i*, 53*a*–53*i*, 54*a*–54*i* are wound in the direction of the arrows with the direction reversing for each coil layer. The starting wire W used for making this coil 50 has an insulation such as enamel or polymer I on it for turn-to-turn insulation. This insulation I is not shown in FIG. 6, for reasons of clarity, but is shown in the enlarged view of the wire W in FIG. 7. This insulation I completely surrounds all external surfaces of the wire W. As pointed out above, in a helically wound coil of this type, the voltage between the layers varies along the coil axis, or width, with the greatest voltage difference between layers occurring between the starting end 51*a*, (52*a*), (53*a*) of a low layer and a finished end 52*i*, (53*i*), (54*i*) of the layer above it. There is almost no voltage difference between the two layers 51*i* and 52*a* (52*i* and 53*a*) on opposite sides of the coil 50. As may be seen in FIG. 6, a variable thickness of insulation 55 is applied to the turns in each layer 52–54 of the coil so that the insulation decreases in thickness from a maximum at the first turn at the start of the layer 51*a*, 52*a*, 53*a*, 54*a* where layer-to-layer voltage stresses will be high to substantially zero thickness of the last turn 51*i*, 52*i*, 53*i*, 54*i*, at the end of the layer where voltage stresses will be low and this progression of insulation thickness is repeated on each succeeding layer of the coil. By comparing the coil in FIG. 6 with the coil in FIG. 1 it will be seen that the full width layer insulation 15 of FIG. 1 has been replaced by the variable insulation 55 which reduces the coil build which in turn reduces the size of the entire core/coil assembly and therefore the cost of the coil.

From the foregoing it will be seen that the present invention replaces the full width layer insulation 15 used in the prior art, FIG. 1, and thus reduces coil build which in turn reduces the size of the entire core/coil assembly therefore the cost of the coil 20 or 50. In accordance with the present invention, the method of manufacturing the variable insulated helically wound electrical coil couples the coating process and the winding process into a tandem operation in which the added insulation's location and amount is controlled by the winding machine's controller and program which controls all coil winding functions for each coil design specification entered. The utilization of a conductor speed control, such as a dancer, between the tandem operations to control the acceleration and deceleration provides uniform speeds for the coating operation. The present invention utilizes an ultraviolet or electron beam for instant cure of the insulation coating and an application chamber for the coating process in the tandem operation. The application chamber 34 may apply the insulation coating using the pressure differential principle (commonly known as a "vacuum box") or by application rollers or spray heads within the chamber.

It shall be understood that the invention is not limited to the specific arrangement shown and that further modifications may be made without departing from the spirit and scope of the invention as set forth in the appended claims.

What is claimed is:

1. A method of manufacturing a variable insulated helically wound electrical coil comprising the steps of:

feeding insulated rectangular wire from a supply reel to a coating zone, within the coating zone selectively applying a liquid resin insulation to the wire so it has additional insulation only in those areas of the coil where the greatest dielectric strength is needed, thereafter feeding the insulated wire through at least one curing station to allow curing of the additional insulation prior to winding the cured insulated wire into a coil, and thereafter winding the cured insulated wire into a coil of predetermined shape whereby the portions of the wire having the additional insulation are located in the areas of the coil where the greatest dielectric strength is needed.

2. A method of manufacturing a variable insulated helically wound electrical coil according to claim 1 wherein the coil comprises multiple coil layers, each coil layer comprising multiple turns of wire, wherein the thickness of the insulation is varied in increments during the winding of each layer so that the insulation increases from substantially zero at the first turn at the start of the layer where layer to layer voltage stresses will be low to the required maximum thickness at the last turn at the end of the layer where voltage stresses will be high and repeating the process on each succeeding layer.

3. A method of manufacturing a variable insulated helically wound electrical coil according to claim 2 wherein the additional insulation is applied to the bottom of the turns in the coil layers.

4. A method of manufacturing a variable insulated helically wound electrical coil according to claim 3 wherein the additional insulation is applied to the bottom and sides of the turns in the coil layers.

5. A method of manufacturing a variable insulated helically wound electrical coil according to claim 1 wherein the coil comprises multiple coil layers, each coil layer comprising multiple turns of wire, wherein the thickness of the insulation is varied in increments during the winding of each layer so that the additional insulation is applied to the top of the turns in each of the coil layers with the maximum thickness being applied to the first turn in the coil layer where layer to layer voltage stresses will be high and thereafter incrementally reduced to the last turn in the coil layer where layer to layer voltage stresses will be low and repeating the process on each succeeding layer.

6. A method of manufacturing a variable insulated helically wound electrical coil according to claim 5 wherein the additional insulation is applied to the top and sides of the turns in the coil layers.

7. A method of manufacturing a variable insulated helically wound electrical coil according to claim 1 including the step of coordinating the timing of the resin application to the wire with the winding of the coil so that the proper insulation thicknesses are achieved at the required locations in the coil.

* * * * *